US006561094B1

(12) United States Patent
Schneider et al.

(10) Patent No.: US 6,561,094 B1
(45) Date of Patent: May 13, 2003

(54) DEVICE FOR FIXING A FLEXIBLE PLATE ON A PRINTING CYLINDER

(75) Inventors: Georg Schneider, Würzburg (DE); Karl Robert Schäfer, Rimpar (DE); Roland Bernd Hofmann, Reichenberg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/926,629

(22) PCT Filed: May 25, 2000

(86) PCT No.: PCT/DE00/01701

§ 371 (c)(1),
(2), (4) Date: Nov. 27, 2001

(87) PCT Pub. No.: WO00/73075

PCT Pub. Date: Dec. 7, 2000

(30) Foreign Application Priority Data

May 29, 1999 (DE) ..... 199 24 786

(51) Int. Cl.[7] ..... B41F 27/12; B41F 27/06
(52) U.S. Cl. ..... 101/415.1; 101/378
(58) Field of Search ..... 101/415.1, 378, 101/409, 382.1, 383

(56) References Cited

U.S. PATENT DOCUMENTS

| | | | | |
|---|---|---|---|---|
| 5,483,891 A | | 1/1996 | Reichel | |
| 5,503,072 A | * | 4/1996 | Schneider | 101/415.1 |
| 5,738,012 A | | 4/1998 | Metrope | |

FOREIGN PATENT DOCUMENTS

| | | | |
|---|---|---|---|
| DE | 1 178 442 | | 6/1965 |
| DE | 2 235 119 | | 2/1973 |
| DE | 38 12 137 | A1 | 1/1989 |
| DE | 43 35 140 | C1 | 2/1995 |
| DE | 195 11 957 | A1 | 10/1996 |
| EP | 0 713 770 | A1 | 9/1995 |
| GB | 2 092 069 | A * | 8/1982 |

* cited by examiner

*Primary Examiner*—Leslie J. Evanisko
(74) *Attorney, Agent, or Firm*—Jones Tullar & Cooper, PC

(57) ABSTRACT

A flexible printing plate with bent suspension legs is secured on a cylinder of a printing press by utilization of a base body located in a cylinder groove. The base body supports flexible clamping elements which can engage the suspension legs. The base body may be formed by a plurality of short base bodies to facilitate removal and replacement of the base body.

10 Claims, 4 Drawing Sheets

DEVICE FOR FIXING A FLEXIBLE PLATE ON A PRINTING CYLINDER

FIELD OF THE INVENTION

The present invention is directed to a device for fixing a flexible plate in place on a cylinder of a rotary printing press. The flexible plate has suspension legs that are received in a fastening slit on the cylinder. At least one base body, which receives fastening elements, is situated in the cylinder groove that is located radially inwardly from the fastening slit.

DESCRIPTION OF THE PRIOR ART

A device for fixing a flexible printing plate on the forme cylinder of a rotary printing press having at least one cylinder groove extending in the axial direction is known from DE 43 35 140 C1.

In this prior device, a first, or leading suspension leg, which is beveled at an acute angle, is suspended at an edge of the first groove wall of the cylinder groove of the forme cylinder. A second, or trailing, suspension leg can be placed against the second groove wall, extending approximately in the radial direction of the forme cylinder, of the cylinder groove. The cylinder groove contains a spindle which is pivotable around its axis. Two leaf springs, each of which is distributed over the width of the printing plate, are fastened on the spindle and can be brought into, or out of contact with the suspension legs in the course of pivoting of the spindle.

DE-OS 22 35 119 discloses a device for clamping a printing plate, wherein lead springs are fastened on a pivotable shaft. This shaft is arranged in three stationary bearings.

DE 38 12 137 A1 describes a device for fastening a printing plate. Two pivotable fastening elements are seated in a hollow shaft.

DE 11 78 442 B1 shows a device for fastening a flexible plate with a base body, wherein a length of the fastening elements is less than a length of the base bodies.

EP 0 713 770 A1 describes a device for fastening printing plates by means of leaf springs.

SUMMARY OF THE INVENTION

The object of the present invention is directed to providing a device for fastening a flexible plate on a cylinder of a rotary printing press.

In accordance with the present invention, this object is attained by providing the cylinder with a fastening slit that terminates in a cylinder groove. The groove is radially inward from the slit and carries at least one base body. Typically, several such base bodies are carried in the cylinder groove. Fastening elements, that engage suspension legs of flexible plates, when these suspension legs are inserted into the cylinder groove, are carried by these base bodies. The lengths of the fastening elements are less than or equal to the lengths of the base bodies in the cylinder axial direction.

The advantages to be obtained by the present invention consist, in particular, in that a rugged, simply constructed device, which can be produced cost-effectively, is created. The device in accordance with the present invention can be displaced without the turning of a spindle in only two positions. A further advantage of the present invention lies in that in its axial extension it can consist of several short base bodies. It is possible because of this to remove the device laterally from the cylinder groove, for example for maintenance purposes, without having to dismount the cylinder from the lateral frame. An automatic plate feeding and removal by means of known devices is possible.

BRIEF DESCRIPTION OF THE DRAWINGS

Two preferred embodiments of the present invention are represented in the drawings and will be described in greater detail in what follows.

Shown are in.

DESCRIPTION OF THE PREFERRED EMBODIMENTS

Figure 2:
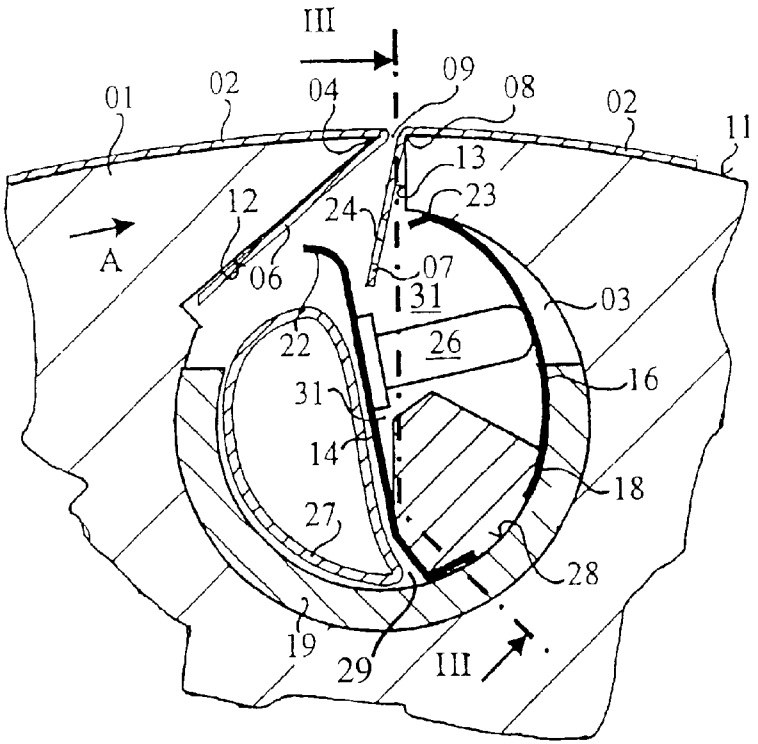

For receiving flexible plates 02, a cylinder 01, for example a plate or a rubber blanket cylinder of a rotary printing press, is provided with at least one cylinder groove 03 extending in the axial direction of cylinder 01. At a front edge 04, pointing in the production direction A of the cylinder 01, the cylinder groove 03 receives a front, or "leading", suspension leg 06 of the plate 02. The plate 02 furthermore has a rear, or "trailing" suspension leg 07, which is suspended from a second, rear edge 08 of the same cylinder groove 03.

An acute opening angle a, for example up to 45°, is formed between a surface 11 of the cylinder 01 and a first cylinder wall 12 of the cylinder groove 03. A second groove wall 13, extending approximately in the radial direction of the cylinder 01, has an obtuse opening angle $\beta$ of approximately 95° in respect to the surface 11. Both edges 04, 08, or vertex points of the opening angles $\alpha$, $\beta$, are separated by a fastening slit 09.

The fastening slit 09 is embodied, in its inner width, in such a way that at least two suspension legs 06, 07, which project into the cylinder groove 03, can be placed therein next to each other.

Figure 1:
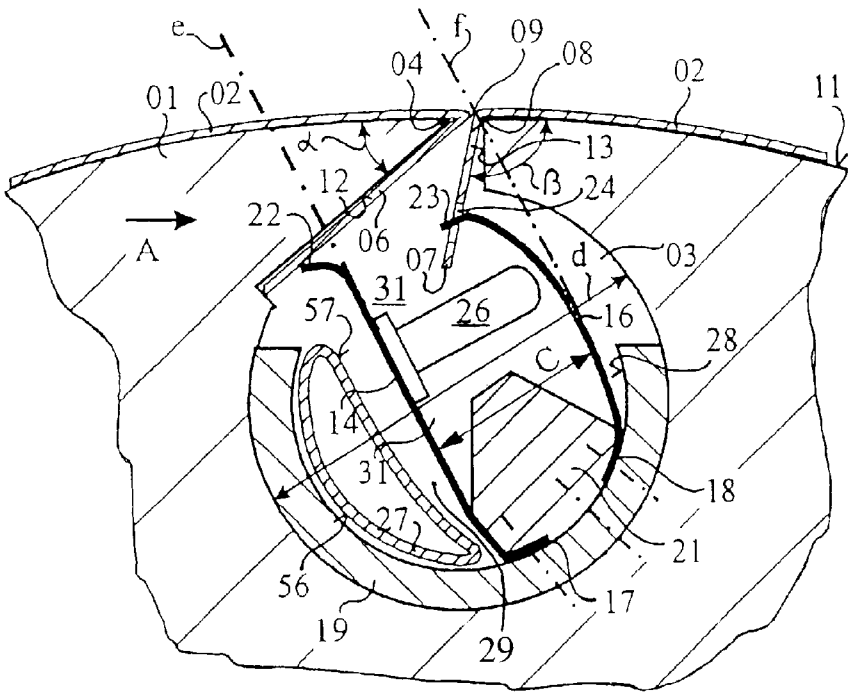
FIG. 1, a device, in accordance with a first embodiment, in cross section in the plate holding position or position of rest, FIG. 2, a device in accordance with FIG. 1 in a plate receiving or operating position, FIG. 3, a section taken along line III—III of FIG. 2 in a partial representation, FIG. 4, a device in accordance with a second embodiment in cross section in the position of rest, FIG. 5, a device, in accordance with the second embodiment, in the operating position, and in FIG. 6, a section taken along line VI—VI of FIG. 4 in a partial representation.

The cylinder groove 03 can be approximately circular in cross section and it is connected with the surface 11 of cylinder 01 through the fastening slit 09. Two springs 14, 16, each made of spring steel, and formed as, for example leaf springs, are arranged in the cylinder groove 03 at a spring spacing distance c from each other—for example with distance c corresponding to approximately half of the diameter d of the cylinder groove 03. A longitudinal axis of the springs 14, 16 extends in an axis-parallel direction in respect to the cylinder 01. A vertical axis e, f of the springs 14, 16, respectively, extends approximately at right angles in relation to the plane of the first groove wall 12, all as shown in FIG. 1.

Lower or radially inner ends 17, 18 of the springs 14, 16, which are remote from the cylinder surface 11, or the suspension legs, are fastened on an abutment, for example a base body 19 with a cross section of a longitudinally cut tube thus having a channel-shaped cross section, which base body 19 extends in an axis-parallel direction in the cylinder groove 03.

A holding strip 21, which is fixed on the base body 19, and on whose lateral faces the lower ends 17, 18 of the springs 14, 16 are fastened, can also be arranged on the base body 19. The two upper or radially outer, free ends 22, 23, which are the spring ends on which the force acts, of the springs 14, 16 are each bent in a hook shape, and their length is such that they are in an operative connection with the suspension legs 06, 07 in the plate holding position or position of rest, again as seen in FIG. 1.

The springs 14, 16 can also be made in one piece, i.e. in a U shape.

To be in operative connection means that the upper, free ends 22, 23 are connected, either frictionally or interlockingly with the suspension legs 06, 07. This frictional connection means that the upper spring end 22 close to the suspension leg 06 presses the front suspension leg 06 against the first groove wall 12. On the other hand, the interlocking connection means that the upper spring end 23, which is bent in a hook shape and is close to the rear suspension leg 07, grips the rear suspension leg 07, which is provided with holes 24, with one or preferably several projections of upper spring end 23 being received in several corresponding holes 24, as shown in FIGS. 1 and 2.

A force-transfer element 26 is located in the vicinity of the free upper spring ends 22, 23, and is positioned between the springs 14, 16. This force-transfer element 26 can extend continuously in an axis-parallel direction with the cylinder groove 03 and can be embodied as a rail, a strip or a cylinder. The force-transfer element 26 can be fastened to both springs 14, 16, or only to respectively one spring 14 or 16 or to the holding strip 21, for example, by means of a third leaf spring, not specifically represented.

It is furthermore possible to embody the force-transfer element 26 "discontinuously", i.e. in the form of a pin, sphere or comb.

Viewed in a cross-sectional view of the device, as seen in FIG. 1, an actuating means, for example a hose 27, which can be filled with compressed air, and which is thus called an air hose, is arranged between the first leaf-shaped spring 14 and the interior wall 28 of the channel-shaped base body 19.

On one of its ends, the hose 27 is provided with a valve, for example, and is charged with compressed air when needed via a line, not represented, to the cylinder journal, and by means of a known rotary lead-in.

The elements 14, 16, 21, 26, which are located in an interior 29 of the base body 19 are collectively called gripping and/or clamping elements, or fastening elements.

The channel-shaped base body 19 can be embodied to be C-shaped or U-shaped in cross section, round, oval or polygonal. The cross section of the cylinder groove 03 is matched to the cross section of the base body 19.

The base body 19 has a base body opening 31 opening or pointing in the direction of the fastening slit 09, through which the elements 22, 23 of the gripping and/or clamping elements 14, 16 project.

If the device is now intended to be brought from the plate holding position or position of rest, shown in FIG. 1, into the plate receiving, or operating position, shown in FIG. 2, the air hose 27 is charged with compressed air. In the course of this, an abutment surface 56 of the air hose 27 rests against the inner wall 28 of the base body 19, and a force-engagement surface 57 of the air hose 27 rests against the spring 14. Because of this, a pivot movement of both springs 14, 16, which are kept spaced apart at a distance c by the force-transfer element 26, takes place, so that the upper legs 22, 23 of the springs 14, 16 come out of engagement with the suspension legs 06, 07 of the plate 02. The plate 02 can be removed, or exchanged. Following the removal of air from the air hose 27, the upper ends 22, 23 of the springs 14, 16 come into operative connection with the suspension legs 06, 07 of the plate 02 now positioned on the surface 11 of the cylinder 01.

Figure 3:
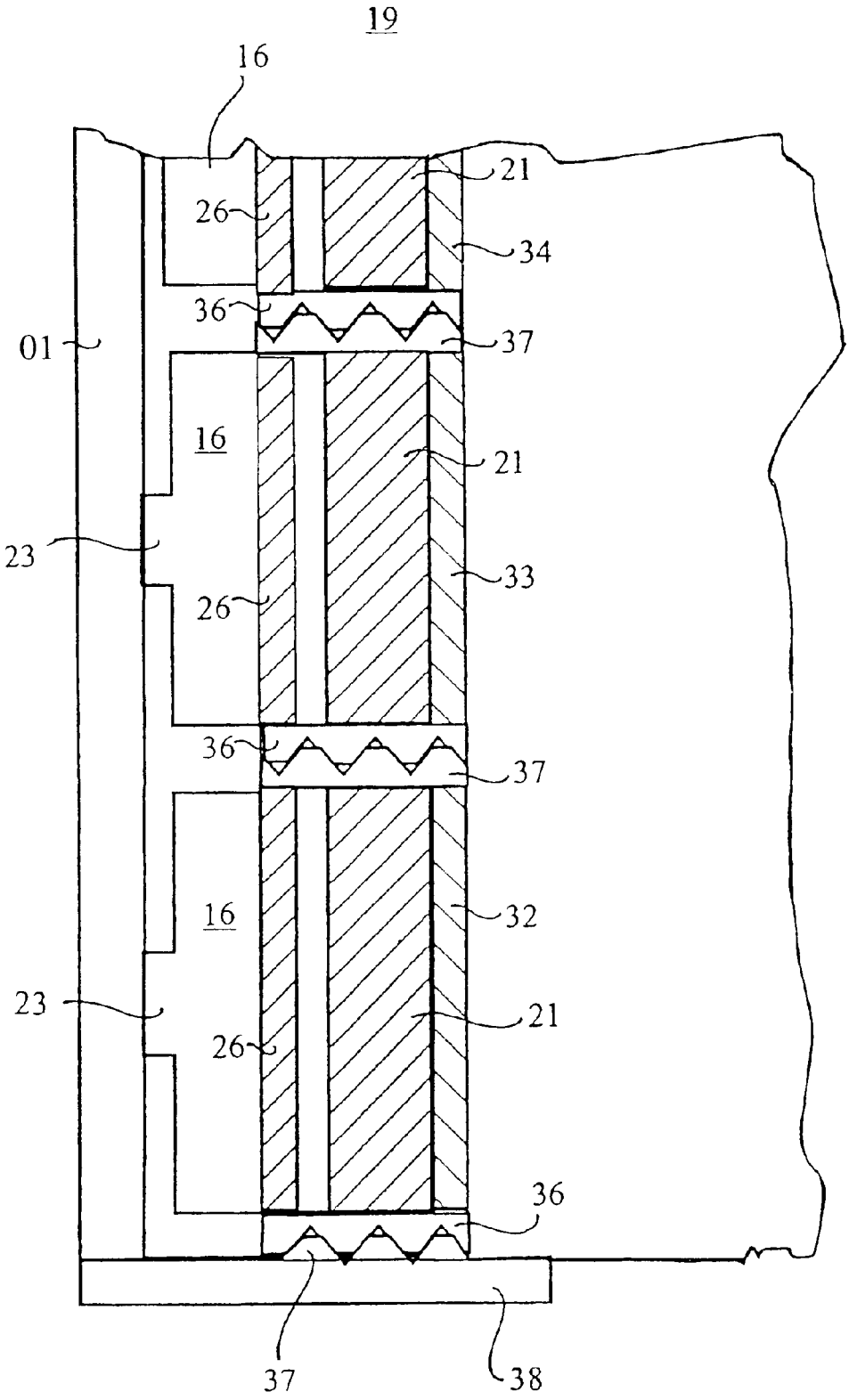

In accordance with an embodiment depicted in FIG. 3, the base body 19 is divided into several short base bodies 32, 33, 34 that are adjacent each other in an axis-parallel direction. Each short base body 32, 33, 34 is releasably connected with the adjoining short base body 32, 33, 34, for example by means of a coupling. This coupling can act interlockingly, for example, and can be implemented by means of teeth 36, 37 on both ends of each of the short base bodies 32, 33, 34. Each short base body 32 to 34, respectively, has springs 14, 16, at least one force-transfer element 26, a holding strip 21, as well as a projection at the upper end 23 of the spring 16. The air hose 27 is always embodied in one piece and passes through all of the short base bodies 32, to 34. Free ends of the first and last short base bodies in the cylinder groove 03 are connected, fixed against relative rotation, with an end coupling element 38. The end coupling element 38 is fastened, with its portions covering the cylinder groove 03, to the flanks of the cylinder 01, for example screwed to it.

By using several short base bodies 32 to 34 it is possible to take the plate holding device out of the cylinder groove 03, for example for maintenance purposes, without it being necessary to dismount the cylinder 03 from the lateral frame.

Figure 5:
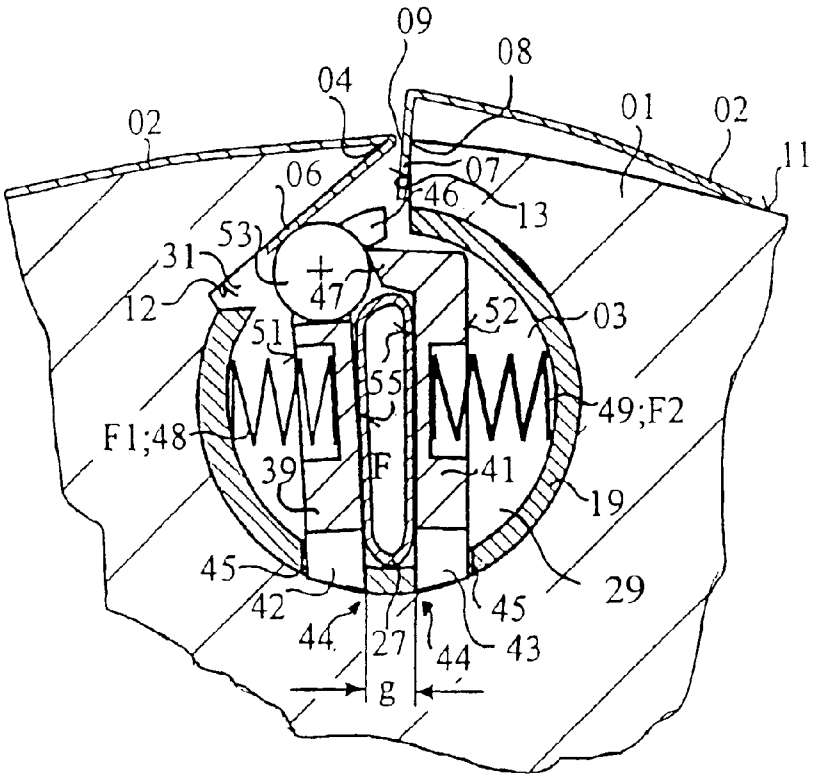
Figure 4:
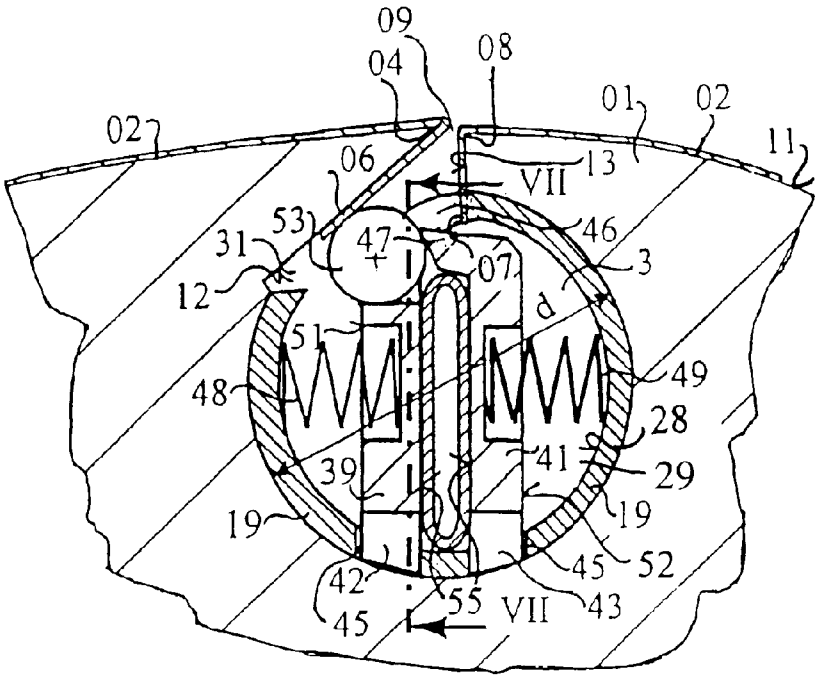
Figure 6:
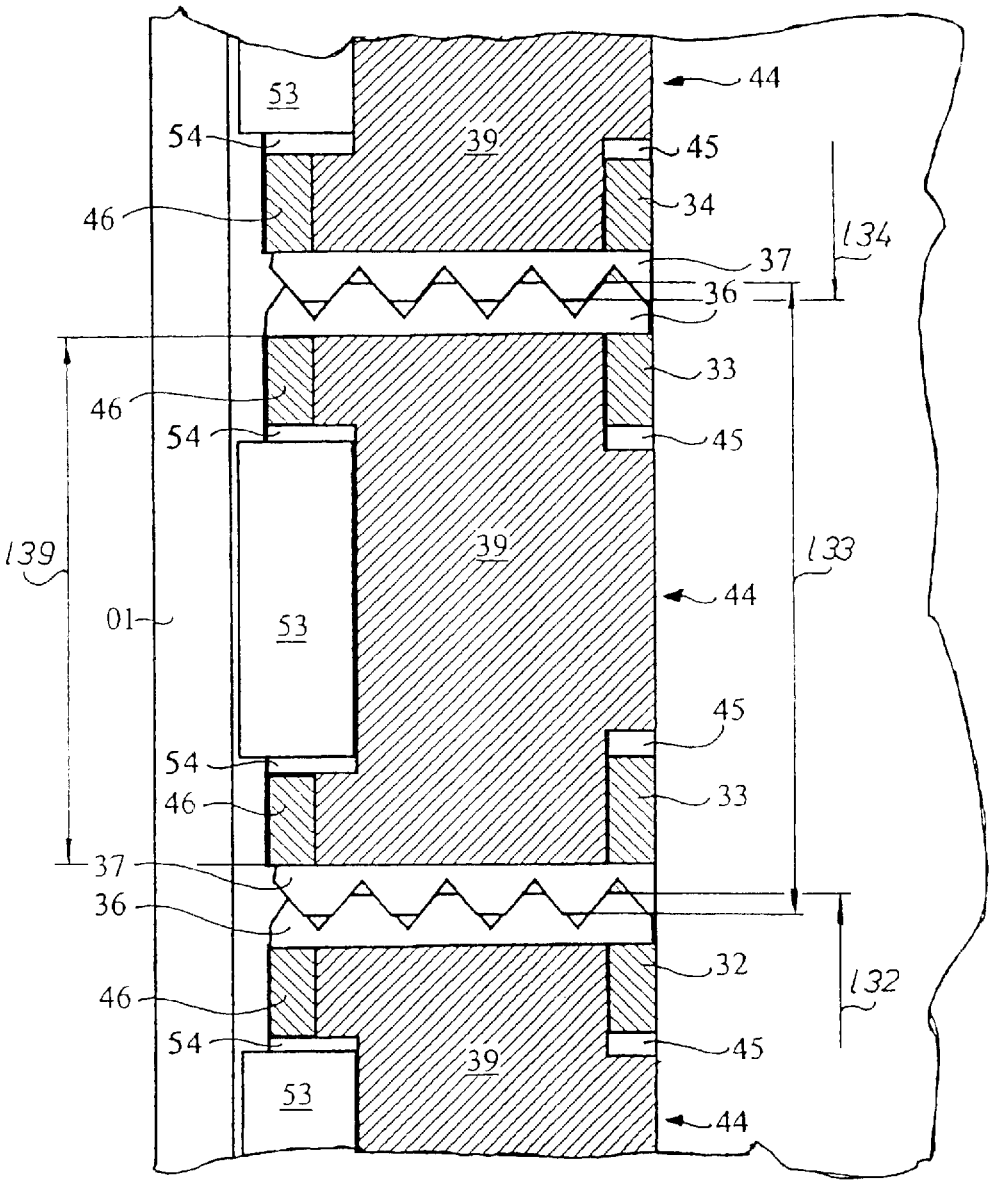

In accordance with a second preferred embodiment which is represented in FIGS. 4 and 5, the gripping and/or clamping elements, which can be moved in the channel-shaped base body 19 or in the short base bodies 32 to 34, as shown in FIG. 6, and which are interlockingly connected with each other, consist of two strips 39, 41 extending parallel with each other. If several base bodies 32, 33, 34 are provided, a length 132, 133, 134 of the respective base bodies 32, 33, 34 is greater than a length 139, 141 of the two strips or fastening elements 39, 41.

First, radially inner or lower ends 42, 43 of strips, 39, 41 respectively, are pivotably seated apart from each other at a clear spacing distance g, of, for example, one-sixth or one-eighth of the diameter d of the cylinder groove 03, in abutments 44. The abutments 44 can consist of slits 45 arranged in the base body 19, or in the respective base bodies 32 to 34, which slits 45 are engaged by portions of the lower or radially inner ends 42, 43 of the strips 39, 41.

Second, radially upper or free ends 46, 47, that are the force-engagement ends, close to the suspension legs and which are bent off at right angles, of the strips 39, 41 are in direct or indirect operative connection with the respectively opposite suspension legs 06, 07 of plate 02 and press them against the first, or the second groove wall 12, 13 by means of the force of respectively at least one spring or several springs 48, 49, for example a pressure spring. The pressure springs 48, 49 are respectively arranged between the inner wall 28 of the base body 19 and the exteriors 51, 52 of the strip 39, 41.

An indirect operative connection means that at least one gripping roller 53 for each short base body 32 to 34 is arranged between the upper end 47, which is beveled in the direction toward the first groove wall 12, of the strip 41 and the suspension leg or legs 06 resting against the first groove wall 12.

The gripping roller 53 of each short base body 32 to 34 lies in a cutout 54 located at the upper end 46, which is near the suspension leg, of the strip 39 as seen in FIG. 6. Respective beveled arms of the upper end 46 of the strip 39 remain on both sides of the cutout 54 and press against the second groove wall 13 or a longitudinal section surface of the base body 19, or prior to that against the suspension leg 07 as seen by referring to FIGS. 4 and 5.

An air hose 27 is located between the inner sides 55 of the strips 39, 41, which air hose 27 extends in one piece over the entire length of the cylinder groove 03.

In accordance with a preferred embodiment, a force of pressure F1 exerted by the spring 48 is smaller than a force of pressure F2 exerted by the spring 49.

The elements 39, 41, 48, 49, 53, located in the interior 29 of the base body 19 embodied in accordance with the second preferred embodiment are collectively called gripping and/or clamping elements. This also applies to the shorter base bodies 32 to 34.

If the device is intended to be brought from the plate holding position or position of rest, shown in FIG. 4 into the plate receiving, or operating position, shown in FIG. 5, the air hose 27 is charged with compressed air, approximately with six bar. By means of this, the upper ends 46, 47 of the strips 39, 41, respectively are moved away from each other against the force F1, F2 of the springs 48, 49. The upper ends or arm 46 of the strip 39, as well as the gripping roller 53 actuated by the upper end 47 of the strip 41, are therefore brought out of engagement with the suspension legs 07, 06.

In accordance with a preferred embodiment, the air hose 27 is initially charged with an air pressure of approximately 3 bar. Thus, a force of pressure F exerted by the air hose 27 is greater than the force of pressure F1 of the spring 48 and less than the force of pressure F2 of the spring 49. The strip 39 is pivoted, and the arms 46 come out of engagement with the rear suspension legs 07. Because of the inherent tension of the plate 02, the suspension leg 07 of the trailing end can pop out of the fastening slit 09 and can be grasped after this.

Following a further increase of the air pressure in the air hose 27 to approximately 6 bar, the force of pressure F exerted by the air hose 27 is now also greater than the force of pressure F2 of the spring 49, so that the suspension leg 06 is also released.

The short base bodies 32 to 34, as depicted in FIG. 6 can be connected with each other, fixed against relative rotation, by teeth 36, 37. An end coupling element 38 each is fastened at the flanks of the cylinder 01, the same as in the first preferred embodiment which is depicted in FIG. 3.

In accordance with a further preferred embodiment, which is a part of FIGS. 4 to 6, it is possible to structure the strip 42 to be slightly longer at its beveled upper edge 47 pointing in the direction of the first groove wall 12, so that the gripping roller can be omitted. Thus, the axis-parallel extending edge of the upper end 47 of the strip 41 touches the front suspension leg 06 of the plate 02 directly and presses it against the first groove wall 12.

In this case, at least the respectively beveled end 47 of the strip 41 can be made of a resilient spring steel or a corresponding plastic material.

While preferred embodiments of a device for fixing a flexible plate in accordance with the present invention have been set forth fully and completely hereinabove, it will be apparent to one of skill in the art that the type of flexible plate secured to the cylinder, the drive means for the cylinder, the specific type of printing press and the like could be changed without departing from the true scope and spirit of the present invention which is accordingly to be limited only by the following claims.

What is claimed is:

1. A cylinder of a rotary printing press in combination with a device for fastening a flexible plate having suspension legs on the cylinder comprising:

a fastening slit on a surface of the cylinder;

a cylinder groove in the cylinder, said fastening slit terminating in said cylinder groove;

at least one base body, fixed against rotation in a circumferential direction of the cylinder, arranged in said cylinder groove, said at least one base body being comprised of a plurality of short base bodies in said cylinder groove, said plurality of short base bodies being arranged next to each other in an axial direction of the cylinder and being coupled with each other fixed against relative rotation, each of said short base bodies having a short base body length; and a plurality of fastening elements arranged in said cylinder groove, each of said fastening elements having an axial length, said axial length being less than or equal to said short base body length, said fastening elements being adapted to engage the suspension legs of the flexible plate.

2. The combination of claim 1 further including an air hose arranged in said cylinder groove and adapted to simultaneously move said plurality of fastening elements.

3. The combination of claim 2 wherein each of said fastening elements consists of first and second strips extending parallel to each other, each of said strips having a first end attached, spaced apart from each other, on said base body, each of said strips having a second, free end located to be engageable with one of the suspension legs of the flexible plate, and further including pressure springs provided between said spaced strips, said pressure springs exerting a force to cause said free ends to engage the suspension legs, said air hose exerting a force on said free ends to disengage the suspension legs.

4. The combination of claim 3 wherein said pressure springs include a first pressure spring acting on said first strip and a second pressure spring acting on said second strip, said first and second pressure springs exerting unequal pressure forces on their respective ones of said first and second strips.

5. The combination of claim 1 further including means for moving each of said plurality of fastening elements independently.

6. The combination of claim 1 wherein said fastening elements are leaf springs having spring forces, each said leaf spring having a first end secured to said base body and having a second end engageable with one of the suspension legs.

7. The combination of claim 6 wherein said spring forces of said leaf springs point in approximately the same direction.

8. The combination of claim 1 wherein said fastening elements engage the suspension legs of the flexible plate in a frictionally connected manner.

9. The combination of claim 1 wherein said base body has base openings and further wherein each of the fastening elements projects through one of said base openings.

10. The combination of claim 1 wherein said base body has a cross-section in a c-shape.

* * * * *